United States Patent [19]

Jeschke

[11] Patent Number: 4,485,737

[45] Date of Patent: Dec. 4, 1984

[54] DEVICE FOR INK PROFILE-DEPENDENT REGULATION DAMPENING SOLUTION

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 500,316

[22] Filed: Jun. 2, 1983

[30] Foreign Application Priority Data

Jun. 2, 1982 [DE] Fed. Rep. of Germany ..... 3220701

[51] Int. Cl.[3] ..... B41F 7/30; B41F 7/36; B41L 25/06

[52] U.S. Cl. ..... 101/148; 101/365

[58] Field of Search ..... 101/148, 349, 350, 351–353, 101/364, 365, 366, 207–210, DIG. 24, DIG. 26

[56] References Cited

U.S. PATENT DOCUMENTS 3,134,326 5/1964 Davis ..... 101/366
3,822,643 7/1974 Mikan ..... 101/148

FOREIGN PATENT DOCUMENTS 2944322 7/1981 Fed. Rep. of Germany ... 101/DIG. 24
1438634 6/1976 United Kingdom ..... 101/148

*Primary Examiner*—J. Reed Fisher
*Attorney, Agent, or Firm*—Herbert L. Lerner; Laurence A. Greenberg

[57] ABSTRACT

Device for ink profile-dependent regulation of dampening solution in an offset printing unit having an inking-dampening unit which, over the width of a type form, supplies a dampening solution film of substantially uniform thickness to the plate cylinder and to the inking part of the inking-dampening unit, including a hydrophilic measuring roller in contact with one of a plurality of inking unit rollers; a measuring device disposed in vicinity of the measuring roller for determining extent of wetting of an outer cylindrical surface of the measuring roller section-by-section over the entire width of the measuring roller and for transmitting corresponding signals; means for varying the proportion of the dampening solution in the ink film section-by-section; and a control stage for converting the signals from the measuring device into adjustment commands and applying them to the proportion varying means for varying section-by-section the proportion of dampening solution in the ink film.

13 Claims, 3 Drawing Figures

1
2
3
4
5
6
7
8
9
10
11
12
12
13
14
15
16
17
18
19
20
21
22
23
24
25
26
27
28
29
33
34
35

DEVICE FOR INK PROFILE-DEPENDENT REGULATION DAMPENING SOLUTION

The invention relates to a device for ink profile-dependent regulation of dampening solution in an offset printing unit with an inking-damping unit which, over the width of the type form, supplies a dampening solution film of substantially uniform thickness to the plate cylinder and to the inking unit.

The correct proportion of dampening solution and ink on the offset printing plate has a considerable influence on the quality of the printed product obtainable with offset printing units. If the dampening solution demand should, for example, exceed the dampening solution supply, this becomes noticeable on the printed image in the form of "scumming" or "smearing". If the plate is excessively dampened, on the other hand, then water-marks are formed. The balances proportion or ratio between the supply of ink and dampening solution is, therefore, within these smear and water-mark limits.

As is generally known, the ink demand of a printed image, as viewed over the width of the printed image, is dependent upon the respective ink surface coverage. This circumstance is taken into account by zonal regulation of the supply of ink. On the other hand, the dampening solution is supplied over the entire plate width by means of a thin uniform film. Depending upon the ink profile, however, the plate also requires more dampening solution in some places than in others. This is remedied by supply a quantity of dampening solution which is averaged over all image areas, relying upon the fact that an ink/dampening solution emulsion forms in the inking unit which creates the necessary balance.

Experience has shown that an averaged supply of dampening solution cannot totally compensate for the dampening solution demand of the plate which differs in accordance with the ink profile. Non-image or print-free edges, in particular, cause problems. The composition of the ink-water emulsions forming in the inking unit differs so greatly that printing difficulties occur notwithstanding that the supply of dampening solution ought to be correct for progress of the printing operation. Consequently, the poor adaptability of the dampening solution supply to the ink profile which is dependent upon the subject considerably narrows the tolerance range between the so-called smearing limit i.e. too little water, and the water-mark limit i.e. too much water.

To remedy this deficiency, German Published Non-Prosecuted application (DE-OS) No. 29 31 579 discloses a device for zonally regulating a dampening solution supply over the width of the type form of an offset printing machine using final adjusting or control elements for zone-by-zone metering of the ink, the final adjusting or control elements for the zone-by-zone metering of the ink having assigned thereto and mutually coupled therewith corresponding zonal final adjusting or control elements for supplying the dampening solution and, in fact, being coupled by means of a matching member having a transfer characteristic which takes into account the parameters influencing the zonal ink-/dampening solution equilibrium.

With this heretofore known device, therefore, the quantity of dampening solution supplied is clearly matched to the quantity of ink on a zonal basis in accordance with a given, generally non-linear characteristic. This connection between the supply of ink and the supply of dampening solution is of great advantage with respect to the printing progress or running on of the machine, but causes considerable problems when starting up again. After each stoppage or interruption in printing, the achieved ink/water distribution immediate collapses. Any water on the plate and on the inking unit evaporates; there is an equalization of ink at least zonally on all of the rollers, the film thicknesses are equalized and any local emulsions change the structure thereof. When the printing machine is started up again, it is absolutely necessary to wet the plate over the entire width of the machine. Frequently, it will even be necessary to over-damp the plate briefly in order to ensure immediate reliable non-printing of the non-image areas. In order to create favorable start-up conditions, therefore, it would be necessary with the heretofore known device to suspend temporarily the coupling of the supply of ink and the supply of dampening solution. Furthermore, with the heretofore known device, there is no compensation for local evaporation due to local overheating.

An object of the invention is to provide a device for ink profile-dependent regulation of dampening solution wherein, viewed over the width of the press, as uniform an ink-water emulsion as possible is achieved in the inking unit irrespective of the ink profile and of local heating. This should not render the start-up conditions unnecessarily difficult, however, but should have a positive effect thereupon.

With the foregoing and other objects in view, there is provided, in accordance with the invention, a device for ink profile-dependent regulation of dampening solution in an offset printing unit having an inking-dampening unit which, over the width of a type form, supplies a dampening solution film of substantially uniform thickness to the plate cylinder and to the inking part of the inking-dampening unit, including a hydrophilic measuring roller in contact with one of a plurality of inking unit rollers; a measuring device disposed in vicinity of the measuring roller for determining extent of wetting of an outer cylindrical surface of the measuring roller section-by-section over the entire width of the measuring roller and for transmitting corresponding signals; means for varying the proportion of the dampening solution in the ink film section-by-section and a control stage for converting the signals from the measuring device into adjustment commands and applying them to the proportion varying means for varying section-by-section the proportion of dampening solution in the ink film.

The concept underlying the invention can be realized in two ways. First, it is possible to supply little water i.e. to cover the minimum demand and, in fact, to supply just enough dampening solution so that under normal conditions the smearing limit is not reached. With this method of dampening, ink will be accepted on the hydrophilic measuring roller and will then be measured by the sensors of the measuring device in those sections wherein there is locally too little dampening solution owing to the very high peaks of the ink profile. At these locations, additional damping will then automatically occur.

The other way of implementing the invention is to supply a great amount of water i.e. to keep the supply of dampening solution just below the water-mark limit. In such a case, dampening solution will collect on the hydrophilic measuring roller, the outer cylindrical surface of which has the same conditions as the plate has, in those areas wherein there is over-damping owing to the valleys of the ink profile. Such over-damping can be eliminated by a doctor blade. If the hydrophilic measuring roller is also cooled, furthermore, the section-by-section imbalance between the supply of ink and the supply of dampening solution will show up faster than on the plate and will thus be able to be eliminated promptly.

By matching the supply of dampening solution to the ink profile, the device according to the invention considerably widens the tolerance range between the smearing limit and the water-mark limit. Start-up conditions are improved. The optimum conditions for running on or for the progress of the printing operation can be brought about in an extremely short time with the device according to the invention because, for example, with the aid of the additional damping device it is possible very quickly to saturate the inking unit with dampening solution. It is merely necessary, therefore, to predampen the plate in order to be able to set the press to running-on or printing progress. Likewise, when using a doctor blade arrangement, it is possible to establish very quickly an ink/water equilibrium by employing the expedient of over-dampening, which is harmless because the possible initial supersaturation of the inking unit with dampening solution may be eliminated at all sections by employing the doctor blade. The invention, therefore, not only widens the tolerance range between the smearing limit and the water-mark limit, but also noticeably improves the start-up conditions.

In accordance with a another feature of the invention, there is provided an additional dampening unit for supplying, in accordance with the adjustment commands of the control stage, to the one of the plurality of inking unit rollers dampening solution in a quantity varying from section to section.

In accordance with a further feature of the invention, there is provided a doctor blade device engageable section-by-section with the hydrophilic measuring roller at a location thereof, as viewed in direction of rotation thereof, after contact thereof with the one inking unit roller, the one inking unit roller having an ink dampening solution profile.

In accordance with an additional feature of the invention, the hydrophilic measuring roller is connected to a cooling device.

In accordance with an added feature, there is provided a device for ink profile-dependent regulation of dampening solution in an offset printing unit, including a combined dampening-inking unit including a chrome measuring roller in contact with a roller of an inking unit roller train for supplying first form rollers through the intermediary of an ink distributer roller: a measuring device having a plurality of sensors disposed parallel to the chrome measuring roller for measuring a section-by-section change in wetting of the chrome measuring roller and transmitting corresponding signals to an electronic control stage; the control stage having means for converting the signals into adjusting commands and applying them to an additional dampening unit; the additional dampening unit being disposed along an inking unit roller nearer in an inking unit train to an ink duct than the inking unit roller in contact with the chrome measuring roller; the additional dampening unit including a plurality of dampening solution applicator units controllable section-by-section by the control stage for supplying, in accordance with the adjusting commands thereof, dampening solution to the inking unit roller nearer to the ink duct.

In accordance with yet another feature of the invention, the dampening-inking unit includes a dampening solution duct, and the dampening solution applicator units are formed of ultrasonic atomizers fed by a pump connected to the dampening solution duct.

In accordance with yet a further feature of the invention, there is provided a device for ink profile-dependent regulation of dampening solution in an offset printing unit having a combined inking-dampening unit including a chrome measuring roller, an inking unit roller and an ink distributor roller successively in contact with one another for supplying first form rollers; a measuring device having a plurality of sensors disposed parallel to the inking unit roller for sensing conditions thereon and transmitting signals corresponding to the sensed conditions to an electronic control device; a dampening solution doctor blade likewise disposed parallel to the inking unit roller, the dampening solution doctor blade being engageable section-by-section with the inking unit roller; the doctor blade having blade sections and adjusting means for displacing the blade sections into and out of engagement with the chrome measuring roller in accordance with adjustment commands from the electronic control device.

In accordance with yet an additional feature of the invention, there is provided another form roller cooperating with the chrome measuring roller and being in contact exclusively with the ink distributor roller supplying the first form rollers.

In accordance with yet an added feature of the invention, the blade sections are formed as, respectively, winding-up and unwinding suction strips.

In accordance with an alternate feature of the invention, the blade sections are formed as suction surface members pivotable into engagement with the chrome measuring roller.

In accordance with still a further feature of the invention, the sensors of the measuring device are displaceably disposed parallel to the inking unit roller, the change of wetting of which is being measured.

In accordance with again another feature of the invention, the one inking unit roller has a variable dampening solution profile, and the blade sections are displaceably disposed parallel to the one inking unit roller for varying the dampening solution profile thereof.

In accordance with a concomitant feature of the invention, the inking unit roller nearer to the ink duct has a variable dampening solution profile, and the dampening solution applicator units are displaceably disposed parallel to the inking unit roller nearer to the ink duct for varying the dampening solution profile thereof.

Other features which are considered as characteristic for the invention are set forth in the appended claims.

Although the invention is illustrated and described herein as embodied in device for ink profile-dependent regulation dampening solution, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
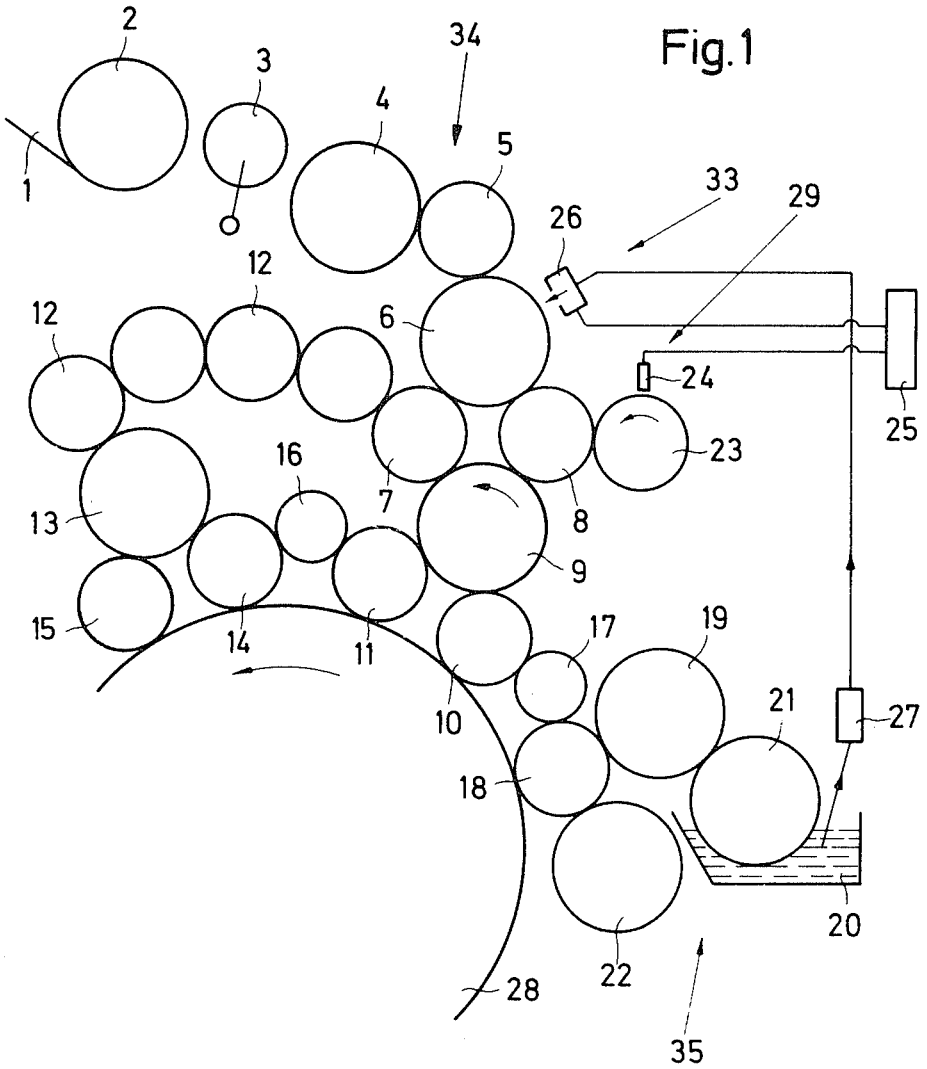
FIG. 1 is a diagrammatic view of an embodiment of a inking-dampening unit according to the invention with an additional dampening unit.

Referring now to the drawing and, first, particularly to FIG. 1 thereof there is shown an inking unit formed of an ink duct 1 with an ink duct roller 2, an adjacent ink feed roller 3 which supplies ink to a first ink distributor roller 4 from the ink duct roller 2. Through the intermediary of a rubber-covered roller 5, the first ink distributor roller 4 is connected to a second ink distributor roller 6. The latter is also in contact with a distribution roller 7 and an inking unit roller 8. Both of the last-mentioned inking unit rollers 7 and 8 are in contact with a third ink distributor roller 9 which feeds a first pair of form rollers 10 and 11 with ink. From the distribution roller 7, a second train of the inking unit branches off in the form of a chain of four inking unit rollers 12, the last of which in the chain is in contact with a fourth ink distributor roller 13 which feeds a last pair of form rollers 14 and 15 with ink. The form rollers 11 and 14 are connected through the intermediary of a rider roller 16. An intermediate roller 17, moreover, forms a bridge between the very first, purely ink form roller 10 and an ink dampening solution form roller 18 which, via a metering roller 19, is supplied with dampening solution from a duct or dipping roller 21 which dips into the dampening solution duct 20. A dampening solution distributor roller 22 which runs together with the ink dampening solution form roller 18 ensures uniformity of the dampening solution film.

The inking unit roller 8 connecting the second and third ink distributor rollers 6 and 9 is contacted by an hydrophilic measuring roller, more specifically, a chromed measuring roller 23. Disposed parallel with this chromium measuring roller 23, at regular spacing from one another, are a row of a measuring device 29. They are connected electrically to an electronic control stage 25. Disposed likewise parallel with the second ink distributor 6, at identical spacing from one another, are a series of dampening solution applicator units 26 of an additional dampening unit 33. These dampening solution applicator units 26 may be in the form of ultrasonic atomizers. They are electrically connected to the hereinaforementioned electronic control stage 25. The dampening solution applicator units 26 of the additional dampening unit 33 are supplied with dampening solution by a pump 27 which draws dampening solution from the dampening solution duct 20.

The five form rollers 18, 10, 11, 14 and 15 are disengageable from a plate cylinder 28 of the printing machine. Through the intermediate roller 17, on the one hand, dampening solution is supplied directly into the inking unit 34, and, on the other hand, ink also is supplied to the ink dampening solution form roller 18.

While the printing is in progress, the dampening unit 35 feeds a uniform dampening solution film onto the plate and into the inking unit 34 in such quantity that specific critical locations of the printed image, for example ink-free or non-image margins, are close to smearing limit with regard to the composition of the ink/water emulsion. Whereas, normally, the chromed measuring roller 23 accepts no ink due to the hydrophilic character of the surface thereof, when there is sufficient dampening of the inking unit roller 8, the measuring roller 23 will, however, accept ink at those locations at which the ink/water emulsion contains too low a proportion of water. Immediately, however, during progress of the printing, that the surface of the chromed measuring roller 23 begins to smear in certain sections, the sensors 24 of the measuring device 29 which are measuring at these locations detect a surface irregularity or disturbance and transmit an appropriate signal to the electronic control unit 25 which converts this signal into an adjustment command, causing the appropriate dampening solution applicator units 26 of the additional dampening unit 33 to spray dampening solution onto the outer cylindrical surface of the second ink distributor roller 6 for as long as it is so directed by the control unit 25. The pump 27 ensures that the opening dampening solution applicator units 26 e.g. ultrasonic atomizers, are constantly supplied with dampening solution. When the chromed measuring roller 23 is again accepting absolutely no ink at the smeared locations, the control unit 25 transmits no more adjustment commands to the corresponding dampening solution applicator units 26, and the spraying of dampening solution onto section by section is continued. This sectionwise spraying-on of dampening solution may take place continuously or periodically, depending upon the requirement reported by the sensors 24 of the measuring device. In this way, it is possible to ensure that, viewed over the entire width of the press, the dampening solution emulsion forming in the inking unit has approximately the same composition constantly. A section-by-section deficiency of dampening solution will show up sooner of the inking unit roller 8 and thus on the chromed measuring roller 23 than on the plate of the plate cylinder 28 because the dampening solution is supplied directly to the inking unit roller 8. Furthermore, the evaporation caused by heat in the inking unit ensures that an insufficiency of dampening solution will cause "smearing" sooner on the chromed measuring roller 23 than on the plate. Therefore, due to the surface conditions on the chromed measuring roller 23 which are similar to those on the plate, it is possible to detect ahead of time where the smearing limit would be reached on the plate if one did not immediately supply dampening solution to the inking unit 34 at the endangered sections.

During start-up after a brief or lengthy stoppage of the printing machine, it is possible to attain equilibrium of ink and dampening solution rapidly in the inking unit 34 by briefly introducing dampening solution into the inking unit 34 from all of the dampening solution applicator units 26 of the additional dampening unit 33. After briefly pre-dampening the plate on the plate cylinder 28, it is thus possible very quickly to establish the conditions required for the progress of the printing i.e. the desired uniform ink/dampening solution emulsion over the entire width of the inking unit.

Figure 2:
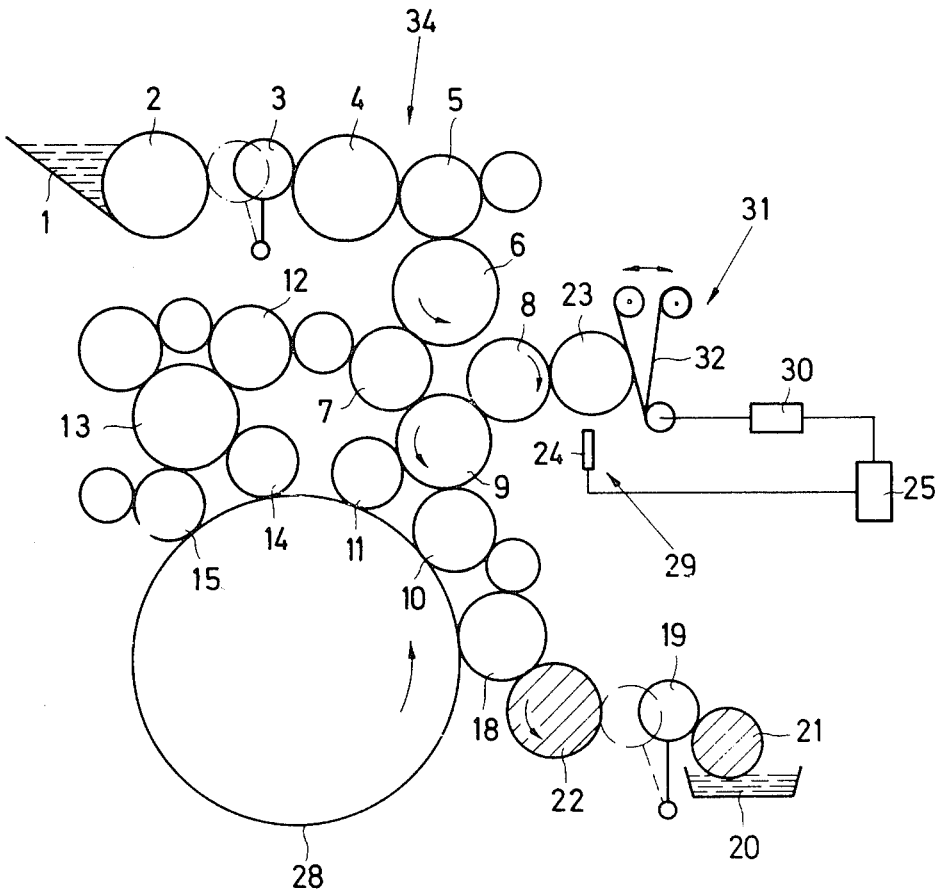
FIG. 2 is a diagrammatic view of an inking-dampening unit according to the invention with a dampening solution doctor blade acting section by section on an inking unit roller.

The inking unit 34 in the embodiment of the invention shown in FIG. 2 differs only insignificantly from the aforedescribed embodiment if one disregards the different arrangement of several of the rider rollers. A conspicuous difference, however, is that the inking unit roller 8 is in contact with only one ink distributor roller exclusively, namely, the third ink distributor roller 9 i.e. is not in contact with the second ink distributor roller 6. Consequently, this inking unit roller 8 is supplied with an ink/dampening solution emulsion which is constantly saturated with dampening solution.

In this case, the metering roller 19 is in the form of a vibrator or lifter roller and the dampening solution distributor 22 lies directly in the flow of the dampening solution. The metering roller 19 which, as mentioned hereinbefore, is a vibrator or lifter takes dampening solution from the duct or dipping roller 21 and supplies it to the dampening solution distributor roller 22 which transmits the dampening solution to the ink dampening solution form roller 18.

The inking unit roller 8 likewise cooperates or interacts with a chromed measuring roller 23 which is connected to an otherwise non-illustrated cooling device. Sensor 24 of a measuring device 29 extend below the chromed measuring roller 23 parallel thereto. The sensors 24 are connected electrically to the electronic control stage 25. The latter, in turn, applies the control commands thereof to an adjusting device 30 which controls a dampening solution doctor blade 31. The latter is formed of a series of blade sections 32 which are disposed along the chromed measuring roller 23 in such a manner that they can be brought into or out of engagement with outer cylindrical surface of the chromed measuring roller 23 either individually or in groups by the adjusting device 30. Preferably, the individual blade sections 32 are formed of a suction strip or belt.

Whenever the blade section 32 in the form of a suction strip or belt is brought into engagement with the outer cylindrical surface of the chromed measuring roller 23, a given stretch or length of the suction strip or belt is wound up so that, with each engagement, a new section of the suction strip or belt comes in contact with the outer cylindrical surface of the chromed measuring roller 23.

A printing unit with an inking dampening unit according to FIG. 2 can be run with a relatively large supply of dampening solution i.e. the supply of dampening solution may be such that, in specific valleys of the ink profile, the ink/dampening solution emulsion has too high a percentage of dampening solution so that in these sections of the printed image there is danger of the occurrence of water marks. Before this sectionwise surplus of dampening solution becomes noticeable on the printing plate of the plate cylinder 38, however, the cooled chromed measuring roller 23 will, in these sections, be carrying more dampening solution that in other sections so that the sensors 24 transmit appropriate measurement signals to the control stage 25, and the latter sends converted adjustment commands to the adjusting device 30, as a result of which the doctor blade sections 32 assigned to the thus transmitting sensors 24 are brought into engagement with the outer cylindrical surface of the chromed measuring roller 23 and skim off the excess dampening solution. The section-by-section wiping by the doctor blade ensures that a more-or-less identical composition of the ink/dampening solution emulsion is provided in all regions of the ink profile.

Figure 3:
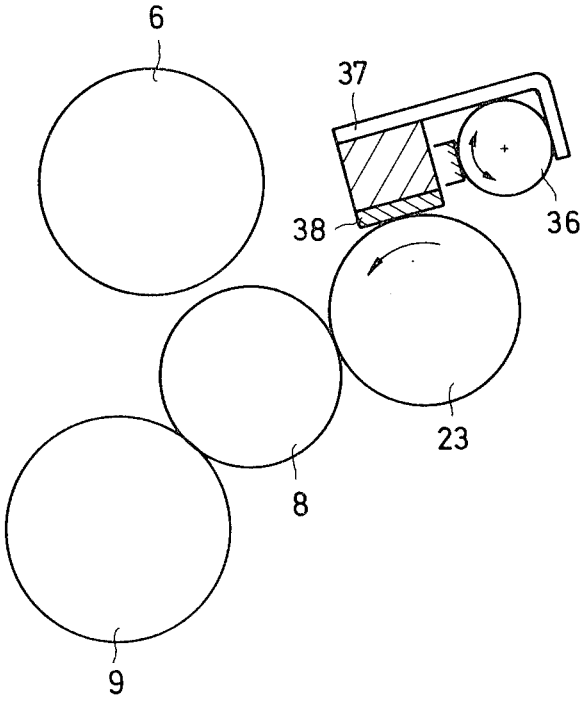
FIG. 3 is a diagrammatic view of a wiper section in the form of an engageable suction surface.

A relatively simplified form of blade sections 32 is shown in FIG. 3. Provided above the chrome-faced measuring roller 23 according to FIG. 2, on an adjusting shaft 36, are several adjacent swivel levers 37 having a suction surface 38 on an end thereof facing towards the outer cylindrical surface of the chromed measuring roller 23. These swivel levers 37 can be brought into or out of engagement with the chromed measuring roller 23 by a non-illustrated conventional actuating or adjusting device. The suction surface 38 has such an absorption capacity as to be able, over a long period, to skim off excess dampening solution. Sensors 24 and associated swivel level 37 may be laterally displaceable or adjustable. Under favorable circumstances, therefore, only the sensors 24 and the swivel lever d37 are required for the print-free or non-image margins because these regions of the plate are most susceptible to over-dampening. Of course, the dampening solution applicator units 26 may also be adjustably mounted parallel to the inking unit roller 8, the dampening solution profile of which is to be changed section-by-section as required.

The foregoing is a description corresponding, in substance, to German application No. P 32 20 701.8, dated June 2, 1982, International priority of which is being claimed for the instant application, and which is hereby made part of this application. Any material descrepancies between the foregoing specification and the specification of the aforementioned corresponding German application are to be resolved in favor of the latter.

There are claimed:

1. Device for ink profile-dependent regulation of dampening solution in an offset printing unit having a plate cylinder and an inking-dampening unit which, over the width of a type form, supplies a dampening solution film of substantially uniform thickness to the plate cylinder and to the inking part of the inking-dampening unit, comprising a hydrophilic measuring roller in contact with one of a plurality of inking unit rollers; a measuring device disposed in vicinity of said measuring roller for determining extent of wetting of an outer cylindrical surface of said measuring roller section-by-section over the entire width of said measuring roller and for transmitting corresponding signals; means for varying the proportion of the dampening solution in the ink film section-by-section; and a control stage for converting the signals from said measuring device into adjustment commands and applying them to said proportion varying means for varying section-by-section the proportion of dampening solution in the ink film.

2. Device according to claim 1, including an additional dampening unit for supplying, in accordance with said adjustment commands of said control stage, to said one of said plurality of inking unit rollers dampening solution in a quantity varying from section to section.

3. Device according to claim 1, including a doctor blade device engageable section-by-section with said hydrophilic measuring roller at a location thereof, as viewed in direction of rotation thereof, after contact thereof with said one inking unit roller, said one inking unit roller having an ink dampening solution profile.

4. Device according to claim 1, wherein said hydrophilic measuring roller is connected to a cooling device.

5. Device for ink profile-dependent regulation of dampening solution in an offset printing unit, comprising a combined dampening-inking unit including an inking duct, an inking unit roller train and a chrome measuring roller in contact with a roller of an inking unit roller train for supplying first form rollers through the intermediary of an ink distributor roller; a measuring device having a plurality of sensors disposed parallel to said chrome measuring roller for measuring a section-by-section change in wetting of said chrome measuring roller and transmitting corresponding signals to an electronic control stage; said control stage having means for converting said signals into adjusting commands and applying them to an additional dampening unit; said additional dampening unit being disposed along an inking unit roller nearer in an inking unit train to an ink duct than said inking unit roller in contact with said chrome measuring roller; said additional dampening unit including a plurality of dampening solution applicator units controllable section-by-section by said control stage for supplying, in accordance with said adjusting commands thereof, dampening solution to said inking unit roller nearer to said ink duct.

6. Device according to claim 5, wherein said dampening-inking unit includes a dampening solution duct, and said dampening solution applicator units are formed of ultrasonic atomizers fed by a pump connected to said dampening solution duct.

7. Device according to claim 5 wherein said inking unit roller nearer to said ink duct has a variable dampening solution profile, and said dampening solution applicator units are displaceably disposed parallel to said inking unit roller nearer to said ink duct for varying said dampening solution profile thereof.

8. Device for ink profile-dependent regulation of dampening solution in an offset printing unit having a combined inking-dampening unit comprising a chrome measuring roller, an inking unit roller and an ink distributor roller successively in contact with one another for supplying first form rollers; a measuring device having a plurality of sensors disposed parallel to said inking unit roller for sensing conditions thereon and transmitting signals corresponding to the sensed conditions to an electronic control device; a dampening solution doctor blade likewise disposed parallel to said inking unit roller, said dampening solution doctor blade being engageable section-by-section with said inking unit roller; said doctor blade having blade sections, and adjusting means for displacing said blade sections into and out of engagement with said inking unit roller in accordance with adjustment commands from said electronic control device.

9. Device according to claim 8, including another form roller cooperating with said inking unit roller and being in contact exclusively with said ink distributor roller supplying said first form rollers.

10. Device according to claim 8, wherein said blade sections are formed as, respectively, winding-up and unwinding suction strips.

11. Device according to claim 8, wherein said blade sections are formed as suction surface members pivotable into engagement with said chrome measuring roller.

12. Device according to claim 8 wherein said sensors of said measuring device are displaceably disposed parallel to said inking unit roller, the change of wetting of which is being measured.

13. Device according to claim 8 wherein said one inking unit roller has a variable dampening solution profile, and said blade sections are displaceably disposed parallel to said one inking unit roller for varying said dampening solution profile thereof.

* * * * *